US006058662A

United States Patent [19]

Perko

[11] Patent Number: 6,058,662

[45] Date of Patent: May 9, 2000

[54] EARTH ANCHORS AND METHODS FOR THEIR USE

[75] Inventor: Howard A. Perko, Ft. Collins, Colo.

[73] Assignee: Secure Products, LLC, Ft. Collins, Colo.

[21] Appl. No.: 09/118,315

[22] Filed: Jul. 17, 1998

Related U.S. Application Data

[60] Provisional application No. 60/053,041, Jul. 18, 1997.

[51] Int. Cl.[7] ..... E02D 5/80

[52] U.S. Cl. ..... 52/157; 52/155; 52/165; 52/741.11; 405/232; 405/259.5

[58] Field of Search ..... 52/157, 155, 165, 52/741.11, 741.15; 405/232, 244, 253, 252.1, 259.5

[56] References Cited

U.S. PATENT DOCUMENTS

| | | | |
|---|---|---|---|
| 505,811 | 10/1893 | Brown | 52/157 X |
| 1,109,020 | 9/1914 | Skiff et al. | 52/157 |
| 1,791,368 | 2/1931 | Mullett | 52/157 |
| 3,645,055 | 2/1972 | Roza . | |
| 3,662,436 | 5/1972 | Roza . | |
| 3,710,523 | 1/1973 | Taylor . | |
| 3,742,661 | 7/1973 | Tye . | |
| 3,757,528 | 9/1973 | Finsterwalder et al. . | |
| 3,793,786 | 2/1974 | Jahnke . | |
| 3,810,364 | 5/1974 | Johnson | 52/147 X |
| 3,830,315 | 8/1974 | Love . | |
| 3,906,689 | 9/1975 | Nakayama . | |
| 4,037,373 | 7/1977 | Echtler . | |
| 4,060,994 | 12/1977 | Chitis | 52/155 X |
| 4,074,481 | 2/1978 | Lang et al. | 52/157 X |
| 4,251,963 | 2/1981 | Patterson . | |
| 4,290,245 | 9/1981 | Pardue, Jr. et al. . | |
| 4,316,350 | 2/1982 | Watson . | |
| 4,334,392 | 6/1982 | Dziedzic . | |
| 4,742,656 | 5/1988 | Farmer . | |
| 4,778,142 | 10/1988 | Roba . | |
| 4,800,700 | 1/1989 | May . | |
| 4,854,782 | 8/1989 | May . | |
| 4,979,341 | 12/1990 | Norman et al. . | |
| 4,996,806 | 3/1991 | Platz . | |
| 5,066,168 | 11/1991 | Holdeman . | |
| 5,113,626 | 5/1992 | Seider et al. . | |
| 5,171,107 | 12/1992 | Hamilton et al. . | |
| 5,224,310 | 7/1993 | Edwards et al. . | |
| 5,295,766 | 3/1994 | Tiikkainen . | |
| 5,408,788 | 4/1995 | Hamilton et al. . | |
| 5,482,407 | 1/1996 | Raaf . | |
| 5,575,122 | 11/1996 | Hamilton et al. . | |
| 5,575,593 | 11/1996 | Raaf . | |
| 5,613,458 | 3/1997 | Owen | 52/155 X |
| 5,662,304 | 9/1997 | McDaniel | 52/157 X |
| 5,775,037 | 7/1998 | James | 52/155 X |
| 5,904,447 | 5/1999 | Sutton et al. | 405/263 |
| 5,934,836 | 8/1999 | Rupiper et al. | 405/244 |

FOREIGN PATENT DOCUMENTS

| | | | |
|---|---|---|---|
| 835021 | 2/1970 | Canada | 52/157 |
| 14512 | 8/1980 | European Pat. Off. | 52/157 |

*Primary Examiner*—Laura A. Callo

*Attorney, Agent, or Firm*—Townsend and Townsend and Crew LLP

[57] ABSTRACT

The invention provides exemplary earth anchors and methods for their use. In one exemplary embodiment an earth anchor comprises and elongate hub having a trailing end and a leading end. At least one blade is attached to the hub, with the plate having a discontinuous circular periphery. The blade is configured such that a continuous circle drawn around the periphery of the blade defines an area. The blade has an area that is less than about 70% of the area of the circle, and the ratio of a path at shear resistance for the blade to the perimeter of this circle is greater than about 90%. Tubular extensions are attached to the hub and poured above the hub to facilitate injection of a low-strength, impermeable non-cementitious chemical grout in order to seal potential paths for water created by installation of the anchor and thereby reducing the risk of increase rate of soil heave in expensive soils.

19 Claims, 8 Drawing Sheets

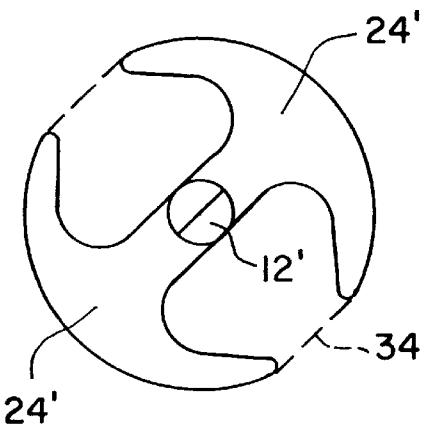
Fig. 6
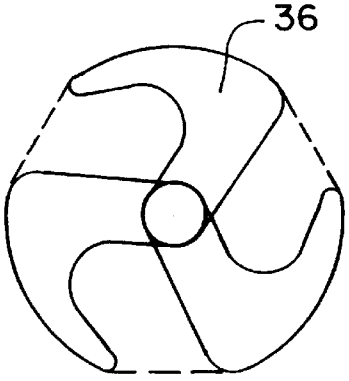
Fig. 7
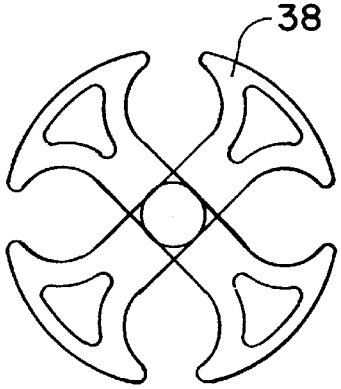
Fig. 8
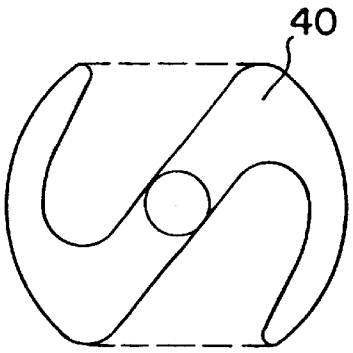
Fig. 9
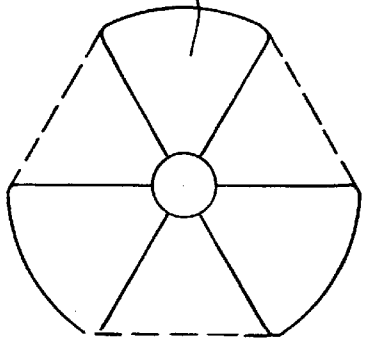
Fig. 10
Fig. 11
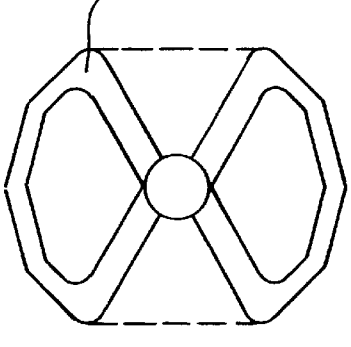
Fig. 12
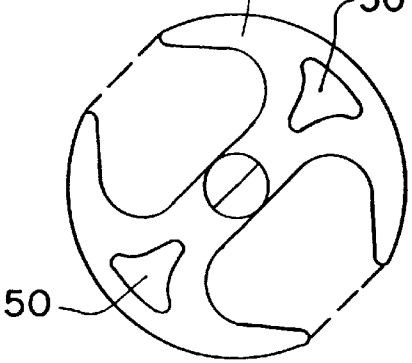
Fig. 13

EARTH ANCHORS AND METHODS FOR THEIR USE

CROSS REFERENCE TO RELATED APPLICATIONS

This application is a continuation-in-part application and claims the benefit of U.S. Provisional Patent Application Serial No. 60/053,041, filed Jul. 18, 1997. The complete disclosure of this reference is herein incorporated by reference.

BACKGROUND OF THE INVENTION

The invention relates generally to the field of earth anchors. In particular, the invention relates to earth anchors having load bearing elements in the form of a helix to serve as a foundation or anchor for buildings and other structures.

The use of earth anchors to provide a foundation or anchor for buildings or other structures is well known. A typical earth anchor for embedment within the ground has a central hub with one or more load bearing elements in the form of a spiral blade which extends radially outward from the central hub. Such earth anchors are turned into the ground to a desired depth, typically between about five to about forty feet, using a torque head that is typically mounted to a back hoe or front-end loader. The earth anchors may be used singly as foundations for structures such as billboards, traffic signs, light poles, utility poles, and the like. They may also be used in groups to found residential and light commercial buildings. Further, such earth anchors may be used as an anchoring device for guy wires, and to tie back retaining walls.

The load bearing elements of many prior art earth anchors are typically spacedly arranged in a manner that results in each element penetrating the soil at a different position, i.e., a subsequent element does not necessarily follow the path cut by a foregoing element. In addition, many prior art earth anchors have load bearing elements that are crudely shaped and only approximate a helix. Such an inexact arrangement and shape of the elements typically results in a high installation torque prohibiting the use of earth anchors in areas with very hard bedrock. The inexact arrangement and shape of the elements typically results from their manner of construction. The central hub is typically a square bar stock with machined ends. Helical blades are cut from plate steel, such as high strength carbon steel, and bent to approximate a helix. The blades are then welded to the hub.

Another feature of many earth anchors is that they have load bearing elements that are generally circular as viewed from either end of the hub. Such a shape maximizes the outer perimeter of the load bearing elements while minimizing the amount of penetration upon rotational installation. However, such a shape necessarily requires a large amount of material to construct. As such, the cost of such blades can be significant.

Many earth anchors are constructed of carbon steel that is hot dipped zinc galvanized. Carbon steel is often employed to construct the earth anchors because of its relatively low cost. However, carbon steel and zinc generally corrode at equal rates when embedded in the earth. To compensate for such corrosion, earth anchors are often constructed of an excessive amount of carbon steel to prevent corrosive failure. As such, the cost of the earth anchors is significantly increased. The installation torque is also higher because of the thicker members.

Water from surface runoff, irrigation and other sources typically can travel through relatively more permeable backfill placed along building grade beams and foundation walls to an interior or exterior foundation drain. Installation of earth anchors has been speculated to cause a water path that is cut down through the soil by the blades. Some of the water passing by the top of the earth anchor may be conducted down this path, possibly increasing the rate and depth of wetting. In expansive soils, some have speculated that this may result in greater heave. Hence, it would be desirable to provide improved earth anchors and methods for their use which require substantially less torque to introduce the earth anchors into the ground. It would be further desirable if such earth anchors were constructed in a way so as to reduce their overall cost while still providing an adequate load bearing or anchoring capacity. It would be further desirable to construct the earth anchors of a material that has better corrosion resistance and requires less material to construct, thereby further reducing installation torque and cost. It would be still further desirable to provide techniques for sealing water paths adjacent the earth anchor to reduce the chances of soil heave created by soil wetting.

SUMMARY OF THE INVENTION

The invention provides exemplary earth anchors and methods for their use. In one particularly preferable embodiment, an earth anchor comprises an elongate hub having a leading end and a trailing end. At least one blade is attached to the hub, with the blade having a discontinuous circular periphery. The blade is constructed in a manner such that when a continuous circle is drawn around the periphery of the blade, an area is defined. The blade has an area that is less than about 70% of the area of the circle. Further, the ratio of a path of shear resistance for the blade to the perimeter of the circle is greater than about 90%. Construction of the blade in this manner is advantageous in that the perimeter or periphery of the blade is maximized to minimize the chances of soil shear failure. In particular, construction of the blade shape in this manner allows the blade to have a shear strength that is approximately the same as a circular section. At the same time, the blade is constructed to occupy a minimal surface area so that the cost to construct the blade can be greatly reduced.

In one particularly preferable aspect, the blade has an area that is less than about 60% of the area of the circle, and the ratio of the path of shear resistance to the perimeter of the circle is greater than about 95%. In another particular aspect, the blade is helically arranged on the hub. Typically, the earth anchor will include a plurality of spaced-apart blades that are disposed along a central section of the hub. The blades along the central section are preferably spaced apart such that when the leading edge of the hub is placed into the ground and torque is applied to the hub, a leading one of the blades creates a path in the ground, with each subsequent blade in the central section generally following the path created by the leading blade. In this way, the amount of torque required to insert the earth anchor into the ground may be greatly reduced.

In still another aspect, each blade in the central section preferably has essentially the same geometry and is disposed at essentially the same pitch. A variety of blade geometries may be employed in constructing the blades of the central section including a double pendulum geometry, a double sickle geometry, a curved iron cross geometry, a quadruple pendulum geometry, a quadruple sickle geometry, and the like, with a double pendulum geometry being preferred.

In still yet another particularly preferable aspect, the hub has a leading section, and a pair of blades are attached to the leading section at spaced apart locations. Each of the blades of the leading section preferably has a variable radius. The blades at the leading section are configured such that if the blades were placed adjacent to each other, they would have a constant r sin theta value. Use of such blades at the leading section is advantageous in that the r sin theta curve created by the edges is split between two blades so that the moment created during cutting is split equally between two blades, thereby reducing any "wobbling" of the hub during insertion.

In one exemplary aspect, the earth anchor is constructed of a copper containing stainless steel alloy, such as 17-4 stainless steel. Use of such a material is particularly advantageous in that it has a low corrosion rate and high strength. By constructing the blades of the earth anchor to have substantially less area than that of a circle, such a stainless steel material may be employed to construct the earth anchor at a competitive cost.

In still yet another aspect, the leading end of the hub is pointed and the trailing end has a coupling device. In this way, attachment of extensions to the hub is facilitated. Preferably, the end of a last extension is fitted with a pier cap comprising an eyelet, a reinforcing bar, a bearing plate, or other device. In still another aspect, the extensions are tubular and the hub includes a lumen which terminates in a port above the top blade. In this way, a low-strength, impermeable material may be introduced through the extensions and the hub and into the ground to prevent water from accumulating around the earth anchor. In still another aspect, the extensions are tubular with one or more spared-apart ports along the extensions and preferably one port immediately above the connection to the hub. In this way, a low strength impermeable material may be introduced through the extensions and into the ground above the hub to prevent water from following the path created by turning the hub and its blade(s) into the ground.

The invention further provides an exemplary method for inserting an earth anchor into the ground. According to the method, an earth anchor is provided which comprises a hub having a leading end, a trailing end, at least one blade, a plurality of tubular extensions, and a lumen which terminates in a port above the blade. The leading end is inserted into the ground and rotated until the blade is moved a predetermined distance into the ground. A low-strength, impermeable material, such as an acrylic grout or other non-cementitious chemical, is introduced through the extensions and/or the lumen until the material exits the port(s) and fills the voids cut by the path of the earth anchor. Use of such a material is advantageous in that it closes paths in the ground through which water may pass, thereby reducing the chances of soil heave.

BRIEF DESCRIPTION OF THE DRAWINGS

FIG. 6 is a schematic diagram of one of the blades of the earth anchor of FIG. 1 illustrating a path of shear resistance for the blade in phantom line according to the invention.

FIGS. 7–13 are schematic illustrations of alternative blade designs that may be used with the earth anchor of FIG. 1 according to the invention.

DETAILED DESCRIPTION OF THE SPECIFIC EMBODIMENTS

Figure 1:
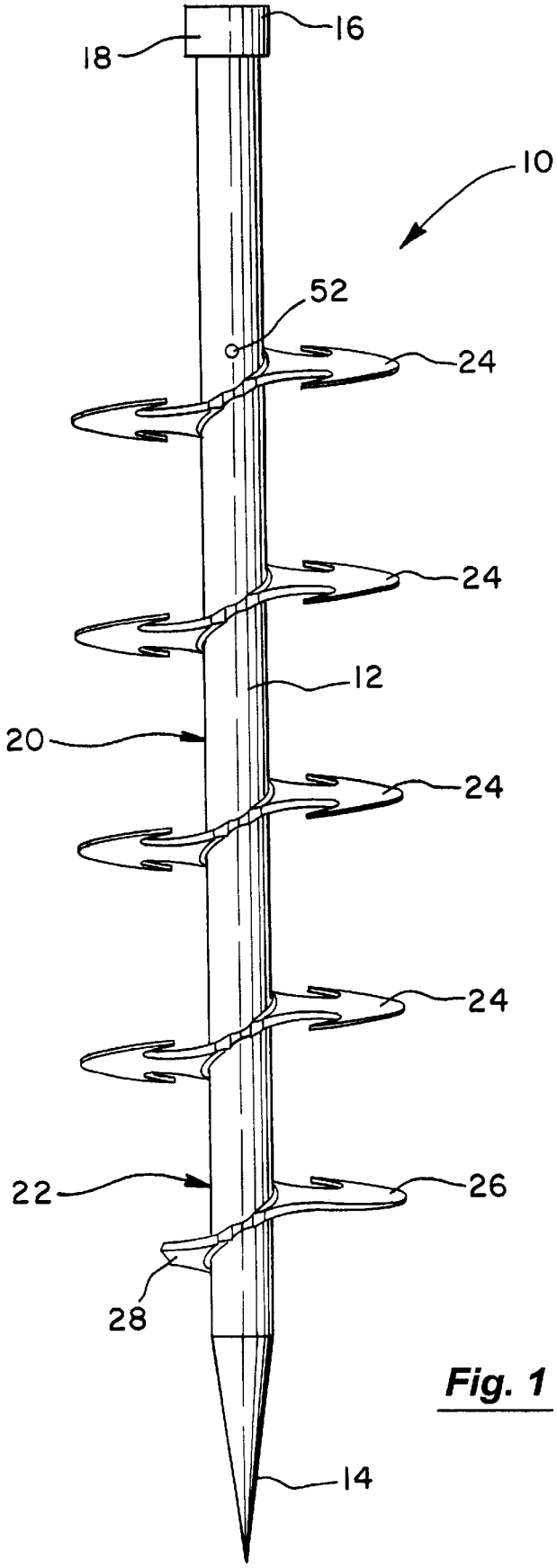
FIG. 1 is a side view of an exemplary earth anchor according to the invention.

The invention provides exemplary earth anchors and methods for their use. The earth anchors of the invention comprise an elongate hub having a leading end and a trailing end, and at least one blade that is attached to the hub. The hub is preferably constructed to be cylindrical in geometry, although other geometries may be employed, including square, polygonal, and the like. As is known in the art, the length and diameter of the hub may be varied according to the particular application. The trailing end preferably includes a coupling or wrench device to facilitate the attachment of various extensions as is known in the art. Once the earth anchor is inserted into the ground the earth anchor may serve as a foundation for various structures such as billboards, traffic signs, light poles, utility poles and the like. The earth anchors of the invention may also be used in groups to found residential and lightweight commercial buildings as well as serving as an anchoring device for guy wires or to tie back retaining walls.

The hub preferably includes a leading section and a central section. The leading section preferably includes a pair of small blades to facilitate initial entry into the ground as described in greater detail hereinafter. The central section includes one or more blades that are preferably helically arranged on the hub. The blades are spaced along the central section such that when the leading end of the hub is placed into the ground and a torque supplied to the hub, the blades in the leading section create a path in the ground, with each subsequent blade in the central section generally following the path created by the leading blade. The blades in the central section preferably have the same geometry and size so that they will follow the path created by the leading blade. Construction of the blades in this manner is advantageous in that a smaller torque may be applied to the hub to insert the earth anchor into the ground. The number of the blades and the distance at which the blades are spaced apart are variable depending on the particular application. However, the blades are preferably spaced apart in a manner such that each blade follows the path created by a previous blade as previously explained.

The blades disposed in the central section are preferably constructed to have a discontinuous circular periphery. Further, a portion of the interior of the blade is preferably removed to reduce the amount of material required to construct the blade. More specifically, the blades are preferably configured such that when a continuous circle is drawn around the periphery of the blade (as viewed from the leading end or the trailing end), a circular area is defined. The blade has an area that is preferably less than about 70%, and more preferably less than about 60% of the area of the circle. Further, the ratio of a path of shear resistance for the blade to the perimeter of the circle is greater than about 90%, more preferably greater than about 95% and most preferably greater than about 97%. Construction of the blade in this manner is advantageous in that the outer periphery of the blade approaches the perimeter of a hypothetical circle drawn around the blade. Such a perimeter is significant because it provides for maximum anchoring capacity and reduces the chance for critical soil shear failure. Because the blade approaches the perimeter of a circle, the blade has the shear strength approximate to that of a circular section. At the same time, the blade is constructed of significantly less material than a corresponding circular blade. In this way, the blade may be constructed significantly cheaper because it requires less material. A preferable geometry for the blades are that of a double pendulum. Alternative geometries include a double sickle, a curved iron cross, a quadruple pendulum, a quadruple sickle, and the like. The cutting edges of the blades may be sharpened in a manner known in the art.

Referring now to FIG. 1, an exemplary embodiment of an earth anchor 10 will be described. Earth anchor 10 is constructed of a central hub 12 having a leading end 14 and a trailing end 16. To facilitate introduction into the ground, leading end 14 is pointed. However, it will be appreciated that leading end 14 may be provided with a semi-spherical or blunt end. Trailing end 16 includes an attachment device 18 such as a socket or wrench which is configured to receive a tubular or solid shaft to transmit torque and which serves as an extension so that earth anchor 10 may be more deeply embedded into the ground. Hub 12 is shown with a generally circular cross-sectional shape. However, it can be appreciated that other shapes may be employed including polygonal, ovular, square, and the like. Further, hub 12 may be solid or tubular in cross section.

For convenience of discussion, hub 12 may be divided into a central section 20 and a leading section 22. Central section 20 includes a plurality of blades 24 which are essentially identical in geometry. Leading section 22 includes a pair of blades 26 and 28 which are smaller than blades 24 and are employed to distribute the torque derived from initial penetration within the ground over more than just a single lead blade as described in greater detail hereinafter.

Blades 24, 26 and 28 are disposed on hub 12 in a helical arrangement. In this way, after blades 26 and 28 cut an initial path in the ground, each of the subsequent blades 24 will follow in the same path, thereby reducing the amount of torque required to insert earth anchor 10 to the ground. As such, blades 24 may be spaced apart from each other at any appropriate distance so long as each subsequent blade follows the path created by the previous blade. Merely by way of example, if blades 24 include a three inch pitch, blades 24 may be spaced apart from each other by any three inch interval, such as every six inches. Further, it will be appreciated that the number of blades employed may be varied depending on the particular application. Further, hub size, blade pitch, blade thickness and blade diameter may be varied according to the particular application. Optionally, blades 24 may be tapered such that the thickness of the blades is greater where it is connected to hub 12 than at the outermost edge where torsion and bending stresses are expected to be smaller. In this way, the amount of material required to construct blades 24 may be reduced. Alternatively, blades 24 may be constructed of uniform thickness. The edges of blades 28, 26 and 24 may be sharpened in any manner known in the art.

Figure 2:
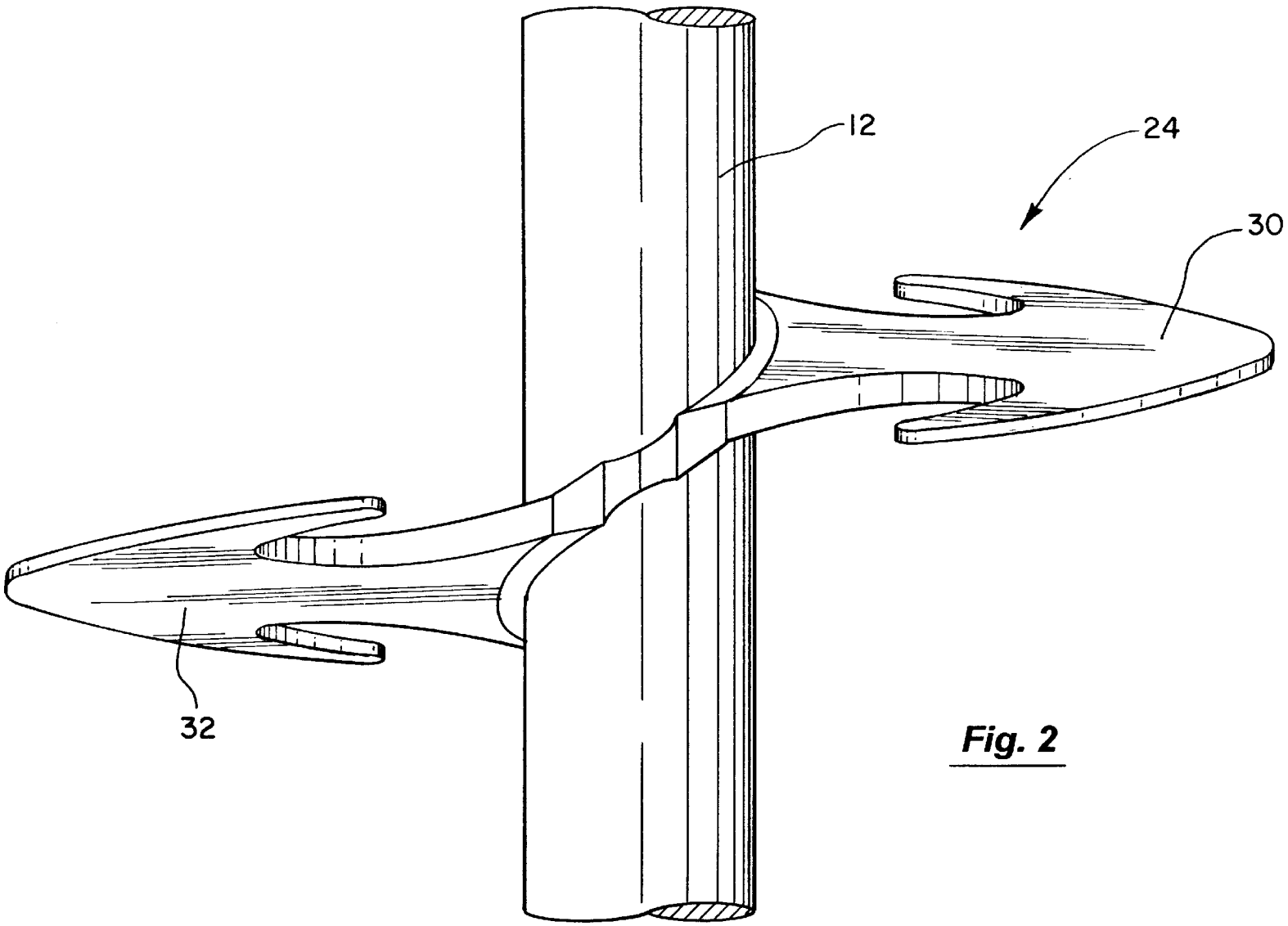
FIG. 2 is a detailed view of a blade of the earth anchor of FIG. 1.
Figure 3:
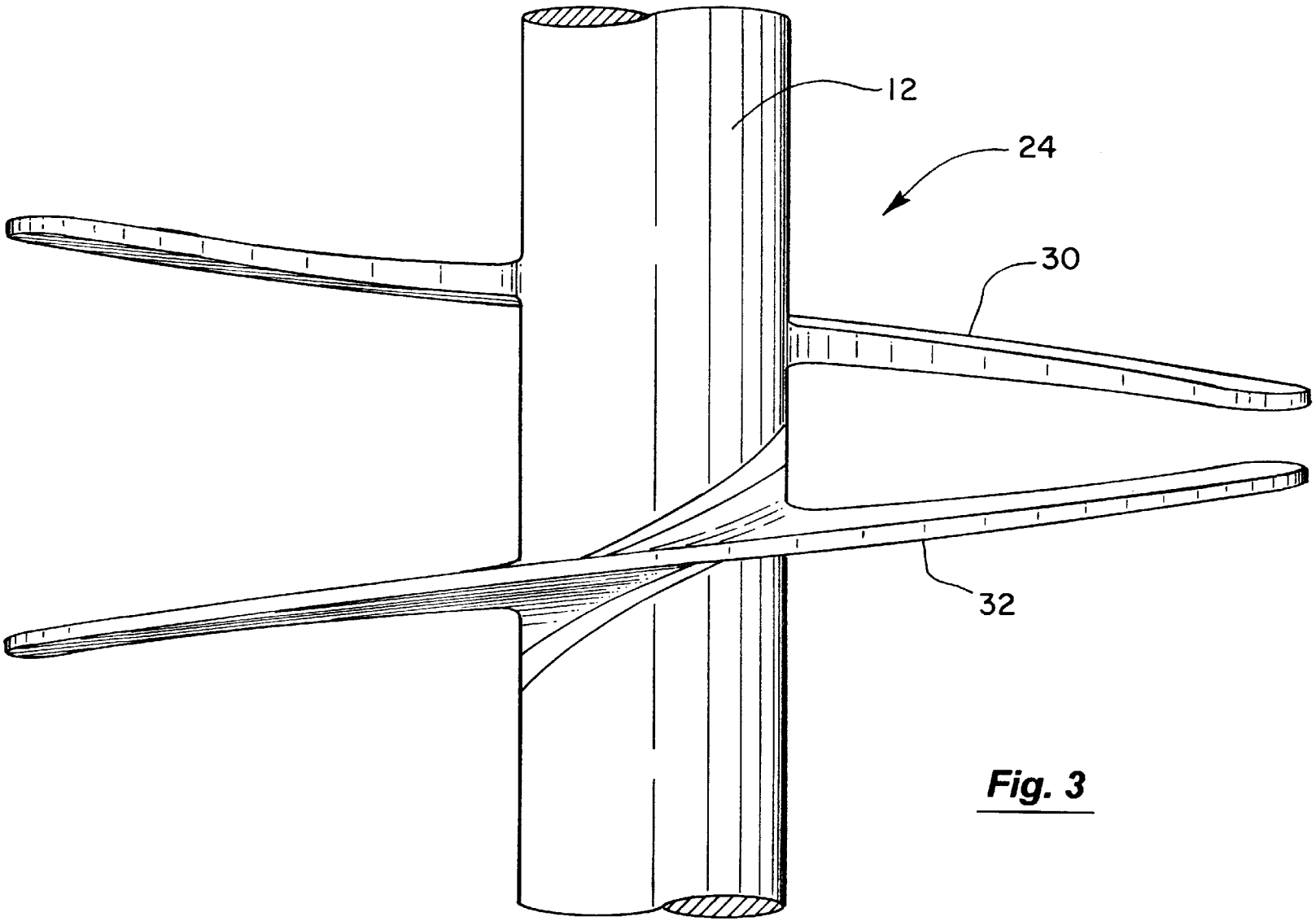
FIG. 3 illustrates the blade of FIG. 2 when rotated 90°.

Referring now to FIGS. 2 and 3, construction of one of blades 24 will be described in greater detail. Each blade 24 is preferably constructed in two sections, 30 and 32, which each have a pendulum geometry. Sections 30 and 32 are preferably cast in a helical geometry and then welded to hub 12. Conveniently, hub 12 may be constructed of a cylindrical bar stock with machined ends. Alternatively, earth anchor 10 may be cast monolithically.

Figure 4:
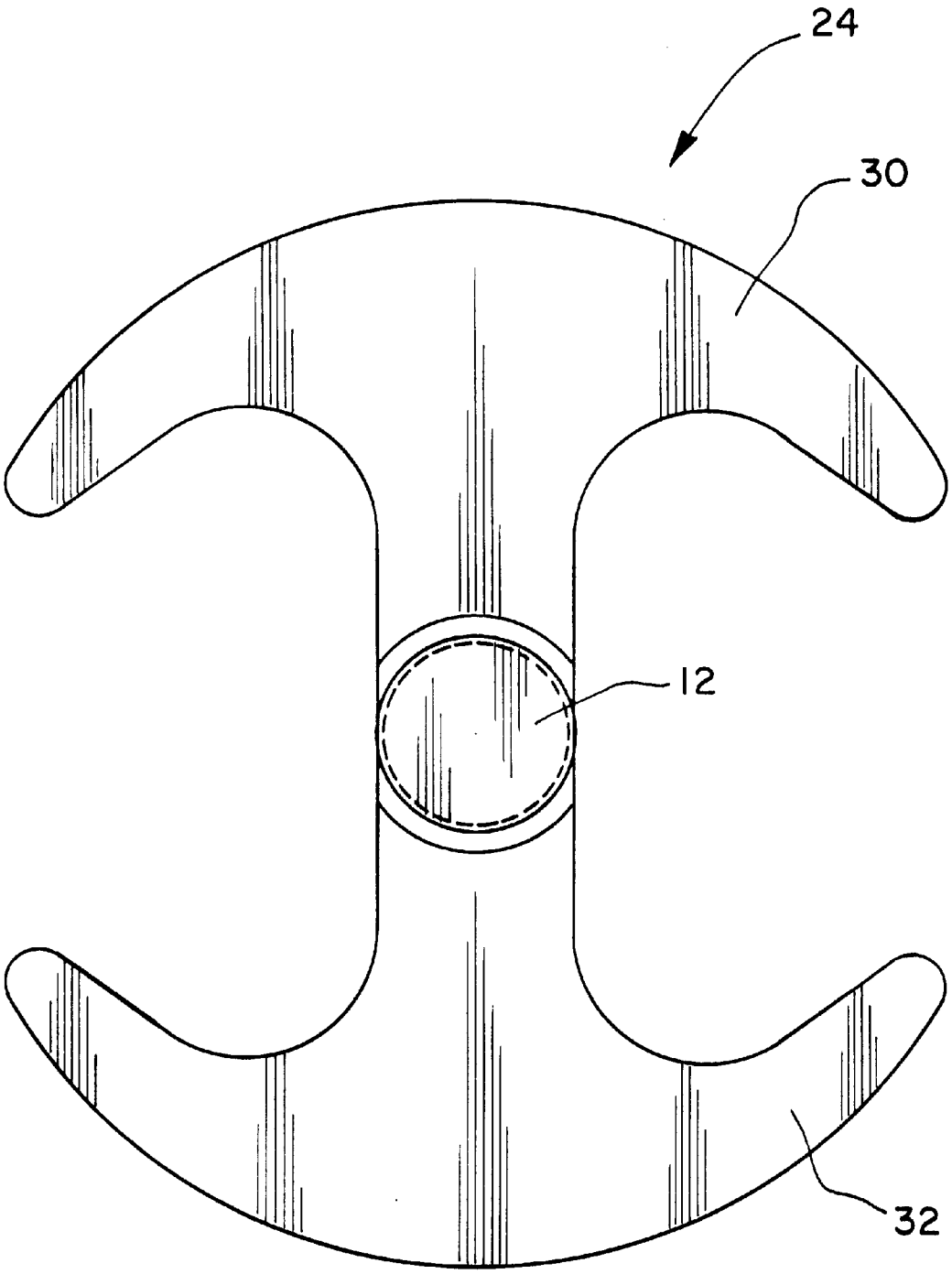
FIG. 4 is a top plan view of the earth anchor of FIG. 1.

As best shown in FIG. 4, each blade 24 has the geometry of a double pendulum when viewed in plan view. The outer perimeter of blade 24 is that of a discontinuous circle. The periphery of blades 24 is constructed to be discontinuous so that less material may be used to construct blade 24 while still having the perimeter of blade 24 approach the perimeter of a circle. The outside perimeter of blade 24 is significant in that the anchoring capacity is determined by the critical soil shear failure surface. By constructing blade 24 so that its periphery approaches the perimeter of a circle, the shear strength of the blade will be similar to that of a circular blade, while using significantly less area. In this way, the amount of material required to construct blade 24 may be significantly reduced.

Such a feature is further illustrated schematically in FIG. 6. In FIG. 6, a blade 24' is shown attached to a hub 12'. A path of shear resistance 34 is shown in phantom line. Path 34 represents a surface at which soil shear failure will most likely occur. Construction of blades 24' as shown is advantageous in that the path of shear resistance 34 approaches that of the perimeter of a circle drawn around blade 24. Conveniently, the relationship between the path of shear resistance and the perimeter of a circle drawn about blade 24' may be summarized by taking a ratio of path 34 to the perimeter of the circle. In the example of FIG. 6, such a ratio is about 0.99. The ratio of the area of blade 24' to the area of the circle drawn about blade 24' is about 0.51. In this way, the critical soil shear failure surface of blade 24' is maximized while minimizing the amount of material used to construct blade 24', i.e. blade 24' has the shear strength approximately equal to a circular section with much less area.

Because blade 24 is constructed with less material, the overall cost of earth anchor 10 may be greatly reduced. Further, by using less area higher strength materials (which tend to be more expensive) may also be used while keeping the cost of earth anchor 10 competitive. Preferably, the blade of earth anchor 10 as well as hub 12 are constructed of a high-strength stainless steel containing copper. Such a material is particularly advantageous in that the rate of corrosion of earth anchor 10 may be reduced. One particularly preferable material is 17-4 stainless steel.

FIGS. 7–13 illustrate alternative blade designs having exemplary shear perimeter ratios and area ratios. FIG. 7 illustrates a tri-sickle blade 36 having a shear perimeter ratio of about 0.99 and an area ratio of about 0.55. FIG. 8 illustrates a quadruple pendulum blade 38 having a shear perimeter ratio of approximately 1.00 and an area ratio of about 0.51. FIG. 9 illustrates a double sickle blade 40 having a shear perimeter ratio of about 0.98 and an area ratio of about 0.45. In FIG. 10, a quadruple triangle blade 42 is shown. Blade 42 has a shear perimeter ratio of about 0.97 and an area ratio of about 0.47. FIG. 11 illustrates a triangular blade 44 which has a shear perimeter ratio of about 0.99 and an area ratio of about 0.53. FIG. 12 illustrates a "figure 8" blade 46 which has a shear perimeter ratio of about 0.96 and an area ratio of about 0.33. FIG. 13 illustrates a double pendulum blade 48 having apertures 50 to further reduce the area of the blade. Blade 48 has a shear perimeter ratio of about 0.99 and an area ratio of about 0.4. It will further be appreciated that other blade shapes may be provided which maximize the shear perimeter ratio while minimizing the area ratio as described above.

Figure 5:
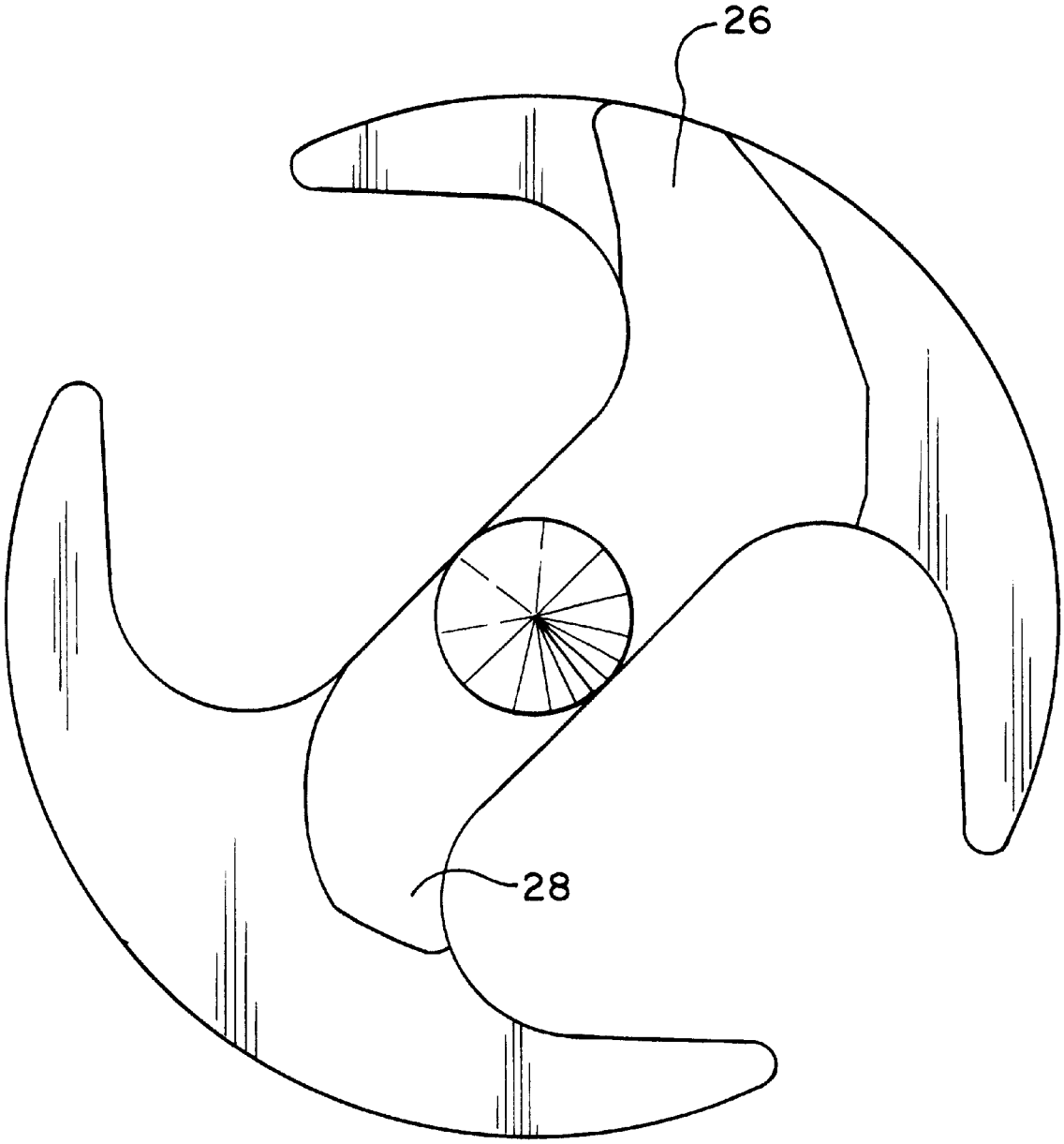
FIG. 5 is a bottom plan view of the earth anchor of FIG. 1.

Referring now to FIGS. 1 and 5, construction of blades 26 and 28 will be described in greater detail. Blades 26 and 28 are constructed such that if blades 26 and 28 were placed adjacent to each other, their perimeter would have a constant $r \sin \theta$ value. As described in U.S. Pat. No. 3,645,055, the disclosure of which is incorporated by reference, use of a blade having a constant r sin θ value is advantageous in that it may more easily be inserted into the ground. With the present invention, the r sin θ curve is split between two blades, i.e., blades 26 and 28, which are disposed on opposite sides of hub 12. The r sin θ curve is split equally between the two blades so as to reduce "wobbling" of the earth anchor as it is inserted into the ground. Further, blade 26 has the same maximum radius as blade 24 so that blade 24 will follow the path cut by blade 26 as previously described.

Referring back to FIG. 1, hub 12 may optionally include a port 52. Hub 12 preferably includes a lumen extending between trailing end 16 and port 52 so that a low-strength, impermeable material may be supplied through port 52 following insertion of earth anchor 10 to the ground. Preferably, the low-strength, impermeable material comprises an acrylic or other non-cementitious chemical grout that is introduced under pressure to seal water paths created by the blades during insertion. In this way, the chances for increased soil wetting and soil heave may be reduced. It is appreciated that a similar result can be obtained by a method not shown in the drawings which includes tubular extensions that have one or more ports spaced apart along the extensions, with preferably one port directly above the connection to the hub at 18 so that a low-strength, impermeable chemical grout can be introduced through the extensions and enter the ground above the anchor 10. Such a grout is different from typical cement grout which creates a bulb of hardened material about the earth anchor to increase its load bearing an anchoring capacity. In swelling soils, a hardened bulb, as used in the prior art earth anchors, may "grab" the anchor and aid its heaval out of the ground.

Following insertion of earth anchor 10 into the ground, the earth anchor may be secured to buildings or other structures by extending reinforcing bars from attachment device 18 as previously described. Alternatively, reinforcement bars may be welded to trailing end 16 or attached by the use of an end cap that has a hook or eyelet for extending the reinforcing bars. The reinforcing bars may be incorporated into a concrete pile cap, a grade beam, foundation wall, or the like as is known in the art. The preferred alternative is to extend the earth anchor to greater depth using solid or tubular extensions of any cross-section as is known in the art. The trailing end of the last extension to enter the ground is fitted with an end cap having a hook, eyelet, reinforcing bars or other method known in the art for securement into a grade beam, pier cap, foundation wall or the like, or for direct attachment to a guy wire, tension cable, bolted plate, sign, post, framing member, or other device.

Figure 14:
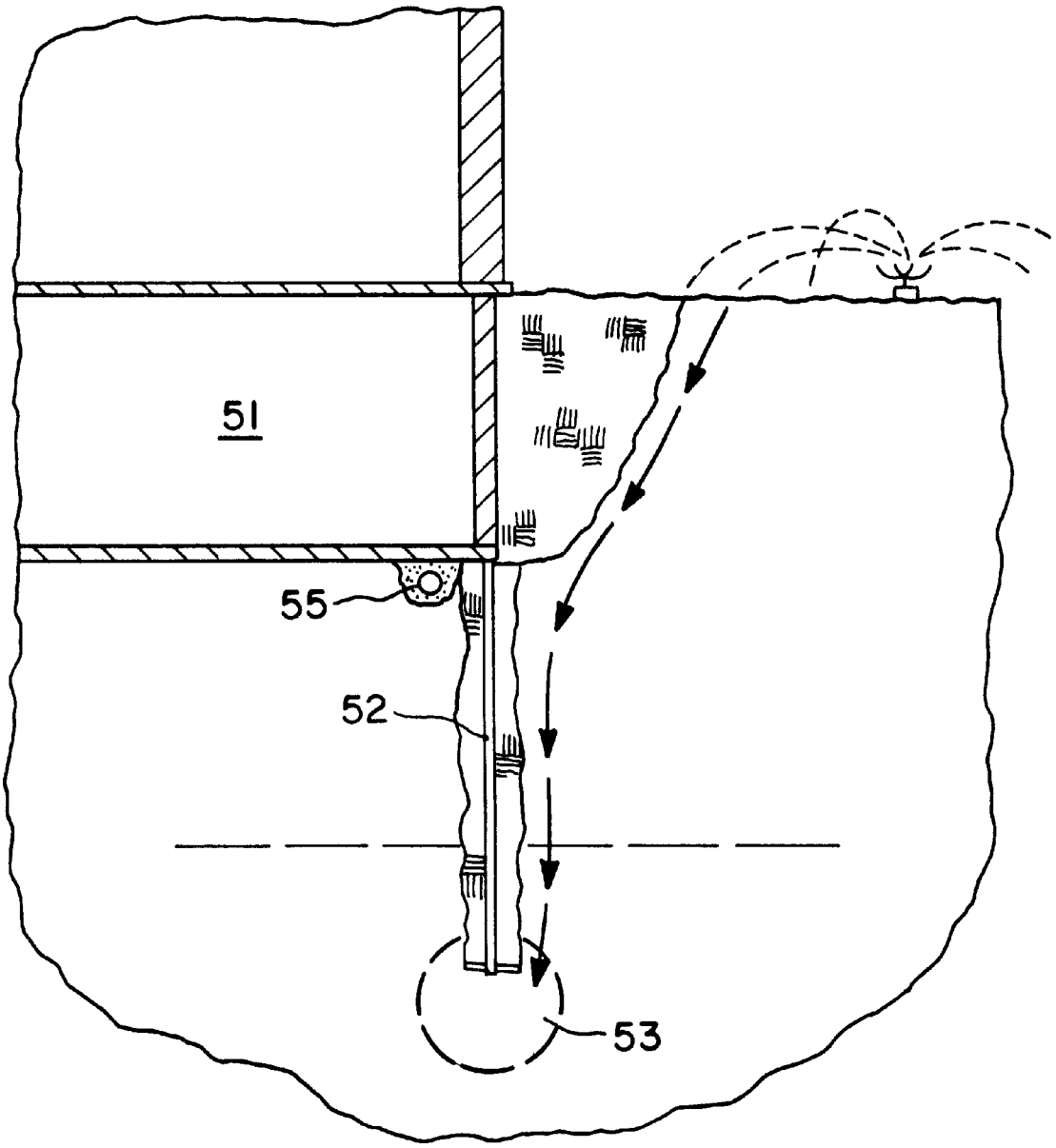
FIG. 14 illustrates a prior art earth anchor when inserted into the ground.
Figure 15:
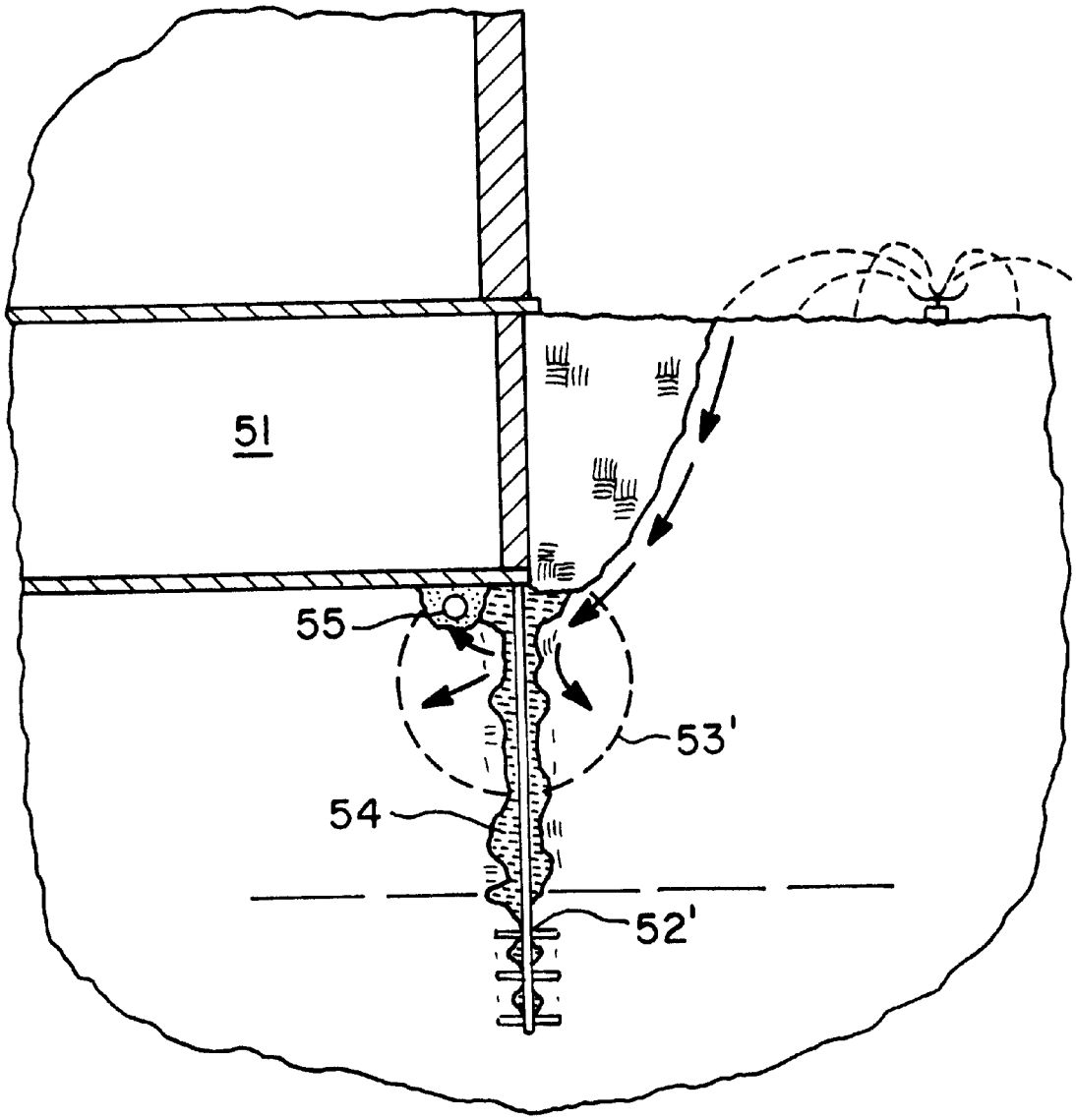
FIG. 15 illustrates an earth anchor that has been pressure grouted according to the invention.

FIG. 14 shows a potential scenario involving a conventionally installed earth anchor 52 used as a foundation for a light structure with a basement 51. Some have speculated that water from surface run-off irrigation or other source may travel through the disturbed relatively more permeable backfill placed adjacent to the basement and thence down the path cut through the soil during anchor installation, and finally collect at 53 located around the helical bearing plate causing soil swell and consequently uplift. FIG. 15 shows an earth anchor 52' that was pressure grouted with a low-strength chemical grout 54 to plug the path cut during installation according to the invention. The grout is injected through the center of a tubular extension used to extend the lead section of the helical earth anchor further below ground, and exits out a port just above the trailing helical blade. Surface water flowing through permeable backfill will be blocked by the pressure grout and either pass between earth anchors and continue on to a foundation drain 55 or collect near the top of the anchor at 53'. Soil swell at 53' is generally anticipated and can be resisted by designing the earth anchor with sufficient anchoring capacity and dead load.

Although the foregoing invention has been described in detail for purposes of clarity of understanding, it will be appreciated that certain changes and modifications may be practiced within the scope of the appended claims.

What is claimed is:

1. An earth anchor comprising:

an elongate hub having a trailing end and a leading end; and at least one blade attached to the hub, wherein the blade has a discontinuous circular periphery;

wherein a continuous circle drawn around the periphery of the blade defines an area, wherein the blade has an area that is less than about 60% of the area of the circle.

2. An anchor as in claim 1, further comprising a plurality of spaced apart blades including said at least one blade disposed along a central section of the hub.

3. An anchor as in claim 2, wherein the blades are helically arranged on the hub.

4. An anchor as in claim 3, wherein the blades along the central section are spaced apart such that when the leading end of the hub is placed into the ground and a torque is applied to the hub, a leading one of the blades creates a path in the ground, with each subsequent blade in the central section generally following the path created by the leading blade.

5. An anchor as in claim 3, wherein each blade in the central section has essentially the same geometry and is disposed at essentially the same pitch.

6. An anchor as in claim 5, wherein the blades in the central section each have a double pendulum geometry.

7. An anchor as in claim 1, wherein the ratio of the path of shear resistance to the perimeter of the circle is greater than about 90%.

8. An anchor as in claim 1, wherein the hub has a leading section, and a pair of blades including said at least one blade attached to the leading section, wherein each of the blades at the leading section has a variable radius r, and wherein the blades at the leading section when placed adjacent to each other have a constant r sin theta value.

9. An anchor as in claim 1, wherein the blade is constructed of a copper containing stainless steel alloy.

10. An anchor as in claim 1, wherein the leading end of the hub is pointed, and the trailing end has a coupling device.

11. An anchor as in claim 1, wherein the hub includes a lumen which terminates in a port above the blade.

12. An anchor as in claim 1, wherein the trailing end of the hub is attached to tubular extensions that are ported above the hub.

13. An earth anchor comprising:

an elongate hub having a trailing end and a leading end; and at least one blade attached to the hub;

wherein the blade has a discontinuous circular periphery, wherein a continuous circle drawn around the periphery of the blade defines an area, wherein the blade has an area that is less than about 60% of the area of the circle, and wherein the ratio of a path of least resistance for the blade to the perimeter of the circle is greater than about 95%.

14. An anchor as in claim 13, wherein the hub and the blade are constructed of a copper containing stainless steel alloy, and wherein the stainless steel alloy comprises 17-4 stainless steel.

15. An earth anchor comprising:

an elongate hub having a trailing end, a leading end, a leading section and a central section; and a plurality of blades attached to the leading section including a leading blade and a following blade, wherein the leading blade is smaller than the following blade, wherein a moment exerted on the leading blade and the following blade during cutting are about the same, and wherein the blades are separated by 180 degrees to prevent wobbling of the hub during insertion.

16. An anchor as in claim 15, further comprising:

at least one blade attached to the hub at the central section.

17. An anchor as in claim 15, wherein the blade at the central section has a discontinuous circular periphery, wherein a continuous circle drawn around the periphery of the blade at the central section defines an area, wherein the blade at the central section has an area that is less than about 70% of the area of the circle, and wherein the ratio of a path of shear resistance for the blade at the central section to the perimeter of the circle is greater than about 90%.

18. A method for inserting an earth anchor into the ground that contains expansive soils, the method comprising:

providing an earth anchor comprising a hub having a trailing end, a leading end, at least one blade, and a lumen which terminates in a port above the blade;

attaching tubular extensions to the hub, wherein the extensions are ported above the hub in one or more locations;

inserting the leading end into the ground that contains expansive soils and rotating the earth anchor until the blade is moved a predetermined distance into the ground; and introducing a low strength, impermeable material into the lumen until the material exits the port and forms a mass filling the voids created by the path of the blades of the hub upon insertion into the ground;

wherein the blade has a discontinuous circular periphery, wherein a continuous circle drawn around the periphery of the blade defines an area, wherein the blade has an area that is less than about 70% of the area of the circle, and wherein the ratio of a path of shear resistance for the blade to the perimeter of the circle is greater than about 90%, and further comprising attaching an extension to the trailing end of the hub.

19. A method as in claim 18, wherein the material comprises an acrylic or polymer chemical grout.

* * * * *